United States Patent [19]

Lake

[11] Patent Number: 4,959,160

[45] Date of Patent: Sep. 25, 1990

[54] PROCESS FOR THE TREATMENT OF CONTAMINATED EMULSION

[75] Inventor: Alan W. Lake, Sandton, South Africa

[73] Assignees: Iscor Limited, Pretoria; Scientific Construction CC., Bryanston, both of South Africa

[21] Appl. No.: 180,993

[22] Filed: Apr. 13, 1988

[30] Foreign Application Priority Data

Apr. 15, 1987 [ZA] South Africa ..... 87/2706

[51] Int. Cl.[5] ..... B01D 17/04

[52] U.S. Cl. ..... 252/340; 252/344; 252/49.5; 210/708; 426/602; 426/605; 426/607

[58] Field of Search ..... 252/344, 340, 49.5; 210/708; 426/602, 605, 607

[56] References Cited

U.S. PATENT DOCUMENTS

| | | | |
|---|---|---|---|
| 1,431,937 | 10/1922 | Dunham | 426/602 |
| 2,357,933 | 9/1944 | DeGroote et al. | 252/340 |
| 2,400,394 | 5/1946 | DeGroote et al. | 252/344 |
| 2,516,913 | 8/1950 | Revukas | 252/340 |
| 2,679,522 | 5/1954 | DeGroote | 252/340 |
| 4,123,357 | 10/1978 | Clements | 210/71 |
| 4,163,727 | 8/1979 | Inks | 252/316 |
| 4,342,657 | 8/1982 | Blair, Jr. | 252/344 |
| 4,515,684 | 5/1985 | Brown | 208/180 |
| 4,738,795 | 4/1988 | Farnand | 252/340 |

OTHER PUBLICATIONS

Bennett, *Practical Emulsions,* Chemical Publishing Company, Inc., Brooklyn, N.Y., 1943, pp. 77–79.

*Primary Examiner*—Mary C. Lee
*Assistant Examiner*—Catherine Scalzo
*Attorney, Agent, or Firm*—Ladas & Parry

[57] ABSTRACT

A process for the resolution of an emulsion which comprises an internal water phase, an external fat and/or oil containing phase and a finely divided metal contaminant which comprises mixing a contaminated emulsion with a volume of water sufficient to increase the total water content to at least 50% on a mass to mass basis, if the water content of the emulsion relative to that of the rest of the emulsion is less than 50% on a mass to mass basis; adding to the emulsion at least one of a suitable emulsifier and demulsifier; mixing the emulsion with a short-chain organic acid to lower the pH from to 3–5 and; allowing the emulsion to settle out into an upper layer comprising the external phase; a lower water layer and a bottom precipitate comprising the contaminant.

18 Claims, No Drawings

PROCESS FOR THE TREATMENT OF CONTAMINATED EMULSION

This invention relates to a process for the treatment of a contaminated emulsion, comprising an internal or dispersed phase which is water, and an external or continuous phase, which may be an oil and/or fat, in order to recover the external phase substantially free of contaminants.

In the rest of this specification the term "fat" will be used to denote fats in both the solid and liquid form.

One example of such an emulsion is found in the hot and cold rolling processes in the metal working industry where blends of fats, for example glyceryl esters of higher fatty acids, fatty acids and mineral oils, are blended with suitable emulsifiers or dispersants to form lubricants which are used to lubricate and cool the rolling equipment. Generally, such a lubricant is applied in admixture with water and sprayed onto the working zone. The waste lubricant which washes from the working zone is collected in a suitable settling tank, and the waste skimmed off. Usually this waste is then collected, drained, and dumped. The process of lubrication usually demands that an excess of lubricant is used, much of which accordingly ends up as a waste.

The largest use of such lubricants is with equipment used in the working of steel. In this instance the waste usually comprises a water-in-fat emulsion which includes contaminants such as iron fines, breakdown products of fats, partially hydrolysed glycerides, and iron soaps. Such a waste is difficult to treat to release the recoverable fats and, to date, many processes have been suggested for the recovery of the fats for possible re-use.

One such a known process, the so called Titzel process, involves cooking the waste under pressure at high temperature to produce a wet fatty substance containing a high proportion of unwanted iron soaps. Another process, again, comprises cooking the waste with a strong mineral acid for a long period to break down and dissolve out all the iron. The resulting product is hard to wash in order to remove the acid, and the product also tends to emulsify with water. In neither of these processes is a fat produced which satisfactory for direct re-use.

Althoutgh it is also known to use the two aforesaid processes successively in order to obtain an iron free end product, such a combined process leads to the generation of a large volume of iron salts in water, which is strongly acid. Thus, the use of the combined processes successively is expensive, wasteful in heating, while a residue is yielded which presents a serious effluent disposal problem.

A third process which has been suggested, is to treat the waste with a demulsifier in acidic conditions. However, this still leaves the problem of final dewatering of the recovered fat.

There is accordingly a need for an improved process for the treatment of an emulsion such as a waste lubricant in order to recover the external phase for re-use, and it is an object of this invention to provide such a process.

According to the invention a process for the treatment of a contaminated emulsion, which comprises an internal phase comprising water, and an external phase comprising a fat, in order to recover the external phase substantially free of contaminants, includes the steps of:

(a) if the water content of the untreated emulsion relative to that of the rest of the emulsion is less than 50% on a mass to mass basis, mixing the contaminated emulsion with a volume of water sufficient to increase the total water content to at least 50% on the said basis;

(b) mixing the emulsion or the product of step (a) with a sufficient amount of a short-chain organic acid to lower the pH thereof to less than 5;

(c) if such components are not already present in a sufficient amount in the emulsion, mixing the product of step (b) with an amount of a suitable emulsifier and, if required, an amount of a suitable demulsifier;

(d) allowing the products of steps (b) or (c) to settle to form an upper layer comprising the external phase substantially free of water and contaminants; a lower aqueous layer; and a precipitate of solid contaminants.

The emulsion is preferalby a water-in-fat emulsion and the process of the invention is preferably designed for the recovery of the external phase of an emulsion containing contaminants, e.g. for the recovery of a fat from a water-in-fat emulsion containing contaminants. The initial product to be treated may, for example, be a used lubricant, e.g. a lubricant used in hot and/or cold rolling processes, a margarine, a cooking fat, a mayonnaise or the like. The end product of the process of the invention is an external phase, i.e. a fat, substantially free of water and contaminants, which is suitable for re-use.

The emulsifier may, for example, comprise a partially hydrolysed ester of a poly hydric alcohol.

When the emulsion being treated is a water-in-fat emulsion, the emulsifier can be the degradation products of the fat, viz. diglycerides and monoglycerides. For other emulsions, the emulsifier may for example, be a sorbitan ester or a glycol ester.

The first step of the process of the invention is, if the water content of the emulsion is less than 50% on a mass per mass basis relative to the rest of the emulsion, to add to the emulsion an amount of water sufficient to ensure that the total volume of the water in the mixture is substantially at least equal to the volume of the rest of the emulsion.

The second step of the process of the invention is to add to the emulsion, or to the mixture of the emulsion and water, a short-chain organic acid in an amount sufficient to lower the pH of the mixture to less than 5, preferably in the order of between 3 and 4. Preferably a short-chain organic acid is used which is both water soluble and fat-soluble.

Examples of suitable short-chain organic acids which may be used include formic acid, acetic acid, propionic acid, butyric acid, hydroxyacetic acid, benzoic acid, capric acid, caproic acid and caprylic acid. Certain of these acids have an unpleasant odour and the preferred acid to use is benzoic acid.

The third step of the process of the invention is, if these products are not already present in the emulsion in a sufficient amount, to add to the mixture resulting from the second step, an amount of a suitable emulsifier and demulsifier. Generally, the addition of emulsifier and demulsifier will be necessary in order to achieve a suitable separation of the external phase from the aqueous component. It will be appreciated that in some instances the emulsion may already contain a sufficient amount of a suitable emulsifier or demulsifier which occur naturally in the emulsion, and that it will then not be necessary to add any additional emulsifier or demulsifier.

The emulsifier may be any suitable one such as one having a water and fat solubility at temperatures up to 70° C. It may be anionic or nonionic with an Hydrophylic-Lipophylic-Balance (HLB) in the order of between 8 and 12. Examples of suitable emulsifiers are certain phosphate esters, such as those sold under the trade name GAFAC RE610 (supplied by General Anilin Fabriek), and Hoechst-Hostaphat M.D. (supplied by Hoechst). These phosphate esters are a mixed mono and di-ester of phosphoric acid and an aliphatic alcohol.

The demulsifier may also be any suitable one. Generally, the demulsifier will be cationic or nonionic, soluble in fat, and with an HLB in the order of between 2 to 5. Examples of suitable demulisifiers include a fatty imidazoline such as that sold under the trade name CASAMINE R (supplied by Shell SA (Pty) Limited), and UNAMIDET (supplied by Lonza), which is a hydroxyethyl fatty acid-imidazoline. These are fatty acid imidazolines.

The emulsifier may be added in an amount of 0,5 to 1 percent by weight of the total weight of the mixture of emulsioon and water.

If necessary, the mixture resulting from step (c) above may be heated to a suitable temperature, preferably up to 100° C., to ensure that the external phase is in liquid form.

The fourth step of the process of the invention is to allow the mixture to settle into an upper and a lower layer, the upper layer comprising the external phase substantially free of water and contaminants, and the lower layer comprising a mildly acidic aqueous layer which is easy to dispose of with a minimal treatment. The precipitate below the bottom layer comprises solid contaminants, such as metal fines.

The product to be treated, i.e. the contaminated emulsion, may also contain other ingredients such as synthetic esters and mineral oils.

Examples of the process of the invention will now be given.

EXAMPLE 1

A fatty lubricant containing approximately 10 percent of fatty acid was used as a lubricant and the waste collected. The waste consisted of 52 percent fat, 40 percent water and 8 percent iron fines. The waste was mixed with an equal volume of water so that the total water content was more than 50% on a mass to mass basis relative to the volume of the rest of the emulsion. This was done in order to make up for the expected water losses which would occur through evaporation during the subsequent heating process. An amount of benzoic acid was then added in a sufficient quantity to bring the pH of the mixture to 3,5, whereafter there was added to the mixture 0.1 percent by weight of a mixture of ethoxylated imidazoline and 0.4 percent by weight of a mixture of a mono and diacid ester of phosphoric acid and a fatty alcohol. The mixture was stirred at 60° C. for three hours and allowed to settle for four hours. This resulted in the formation of an upper layer of fat containing 0.5 percent free water and 0.2 percent iron fines with the percentage fatty acid being 12.5 percent; an aqueous layer containing 1 percent of emulsified fat; and a precipitate of metal fines. The fat layer was separated, centrifuged, and after the original dispersion system was added, was suitable for re-use as a lubricating oil.

EXAMPLE 2

A used tallow-based tin plate rolling oil was collected from a rolling mill as a viscous mixture of fat, water and iron fines.

A quantity of 4 metric tons of the oil at a temperature of 80° C. was poured into a 12,000 liter tank fitted with a steam coil and an air sponge pipe for agitation. Approximately 6,000 liters of water were added together with 25 kg of each of benzoic acid and a phosphate ester. The amount of water used was again an excess for the same reason as stated above. The mixture was heated to 80° C. and agitated with air. After about 6 hours, it was noted that the viscosity of the mixture had fallen to close that of hot fat, and a sample showed water separation taking place as free droplets.

The agitation and heating were terminated and the contents were allowed to settle for about 12 hours. After this period, the oil at the top of the tank assumed a normal brown colour, with a small amount of iron fines being suspended therein. The bulk of the iron fines was contained in a precipitate in the bottom of the tank.

The oil was pumped off into drums until the water layer was reached midway down the tank. The drums were then centrifuged using an Alfa-Laval-type forced ejection centrifuge at a speed of 6000 rpm. A clear brown oil was produced, the water and metal fines being rejected as a heavy sludge. The oil showed less particles in suspension than new oil, no iron soaps, only 0.1 percent of moisture, and it had an acid value of 32 mg KOH/g, which was partly due to the presence of residual additives which are not harmful to re-use.

The oil, mixed on a 50:50 basis with new oil, was found suitable for re-use for rolling. The calculated yield showed that close to 80% of the waste oil content was recovered. Of interest was the fact that due to the treatment under acid conditions no iron soaps were found in the recovered oil, even though present in the waste.

The iron containing precipitate and sludge were of interest as a source of iron fines having a particulate size of from 100 microns down to sub-micron. These iron fines were totally unoxidised and relatively easy to recover.

The above procedure was repeated on a laboratory scale without the addition of the aforesaid additives. The result was a dark, very viscous mass, containing fat, iron soaps, free iron and entrapped water in an amount of over 40%. This compound was found totally unacceptable as a rolling lubricant.

The process of the invention accordingly permits the treatment of an emulsion waste containing a contaminant such as iron fines in order to recover an external phase such as a fat suitable for use as lubricant, cheaply, efficiently and with little pollution. The recovered fat may be re-used, e.g. as a lubricant either as such or mixed with such additives as may be required. The iron fines may also be re-used in many applications, such as in the sintered metal industry, for example.

It will be appreciated that there are no doubt many variations in detail possible with a method according to the invention without departing from the spirit and/or scope of the appended claims.

I claim:

1. A process for the resolution of an emulsion which comprises an internal water phase, an external fat and/or oil containing phase and a finely divided metal contaminant which comprises:

(a) mixing a contaminated emulsion with a volume of water sufficient to increase the total water content to at least 50% on a mass to mass basis, if the water content of the emulsion relative to that of the rest of the emulsion is less than 50% on a mass to mass basis;

(b) adding to the emulsion at least one of a suitable emulsifier and demulsifier;

(c) mixing the emulsion with a short-chain organic acid to lower the pH from to 3-5 and;

(d) allowing the emulsion to settle out into an upper layer comprising the external phase; a lower water layer and a bottom precipitate comprising the contaminant.

2. The process of claim 1 wherein the emulsion comprises a spent lubricant from a metal rolling process.

3. The process of claim 1 wherein the emulsion comprises a spent lubricant from a hot and/or cold rolling process in the steel working industry, and the contaminant comprises iron fines.

4. The process of claim 3 wherein the emulsifier comprises a partially hydrolysed ester of a poly hydric alcohol.

5. The process of claim 3 wherein the emulsifier is a degradation product of the fat.

6. The process of claim 1 wherein the emulsifier comprises a sorbitan ester or a glycol ester.

7. The process of claim 1 wherein the short-chain organic acid contains fewer than ten carbon atoms, and the pH of the emulsion is lowered to from 3 to 4 through the addition of the acid.

8. The process of claim 1 wherein the short-chain organic acid is both water soluble and fat-soluble.

9. The process of claim 1 wherein the short-chain organic acid comprises at least one member selected from the group consisting of formic acid, acetic acid, propionic acid, butyric acid, hydroxyacetic acid, benzoic acid, capric acid, caproic acid and caprylic acid.

10. The process of claim 1 wherein the organic acid is benzoic acid.

11. The process of claim 1 wherein the emulsifier is one having a water and fat solubility at temperatures up to 70° C.

12. The process of claim 1 wherein the emulsifier is anionic or nonionic with an HLB in the order of between 8 and 12.

13. The process of claim 1 wherein the emulsifier is a phosphate ester.

14. The process of claim 1 wherein the demulsifier is cationic or nonionic, soluble in fat, and with an HLB in the order of between 2 to 5.

15. The process of claim 1 wherein the demulsifier comprises a fatty imidazoline.

16. The process of claim 1 wherein the emulsion is heated to a temperature where the external phase is in liquid form.

17. The process of claim 1 wherein the concentration of the emulsifier relative to that of the emulsion is from 0.5 to 1 percent on a mass per mass basis.

18. The process of claim 1 wherein the metal contaminant comprises iron fines.

* * * * *